US012410599B2

(12) United States Patent
Okabe et al.

(10) Patent No.: US 12,410,599 B2
(45) Date of Patent: Sep. 9, 2025

(54) FLUSH TOILET

(71) Applicant: TOTO LTD., Kitakyushu (JP)

(72) Inventors: Daiki Okabe, Kitakyushu (JP); Makoto Bekki, Kitakyushu (JP); Shoko Kobayashi, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 86 days.

(21) Appl. No.: 18/586,799

(22) Filed: Feb. 26, 2024

(65) Prior Publication Data

US 2024/0287778 A1 Aug. 29, 2024

(30) Foreign Application Priority Data

Feb. 28, 2023 (JP) ..... 2023-029575
Feb. 28, 2023 (JP) ..... 2023-029576
Feb. 28, 2023 (JP) ..... 2023-029577
Feb. 28, 2023 (JP) ..... 2023-029578

(51) Int. Cl.
*E03D 11/08* (2006.01)

(52) U.S. Cl.
CPC ..... *E03D 11/08* (2013.01)

(58) Field of Classification Search
CPC ..... E03D 11/08
See application file for complete search history.

(56) References Cited

U.S. PATENT DOCUMENTS

2014/0130246 A1 5/2014 Wu et al.
2018/0080208 A1 3/2018 Hashimoto et al.
2020/0048888 A1 2/2020 Ina et al.

FOREIGN PATENT DOCUMENTS

EP 3269886 A1 1/2018
JP 2005-213883 A 8/2005
JP 2012-207504 A 10/2012
JP 2014-005594 A 1/2014
(Continued)

OTHER PUBLICATIONS

An Office Action; "Notice of Reasons for Refusal," mailed by the Japanese Patent Office on Jul. 30, 2024, which corresponds to Japanese Patent Application No. 2023-029575; resubmitted with English language translation.
(Continued)

*Primary Examiner* — Christine J Skubinna
(74) *Attorney, Agent, or Firm* — Studebaker Brackett PLLC

(57) ABSTRACT

A flush toilet of the present invention comprises: a bowl including a waste receiving surface, a rim formed above the waste receiving surface, and a well portion formed below the waste receiving surface and having a pooled water surface formed in the well portion; a first rim spouting port provided in the rim and configured to spout flush water forward; a first water conduit configured to supply flush water to the first rim spouting port; a second rim spouting port provided in the rim and configured to spout flush water rearward; and a second water conduit configured to supply flush water to the second rim spouting port, in which a bottom surface of the second water conduit is configured to be inclined downward along a water spouting direction of the flush water spouted from the second rim spouting port, and such that an extension line of the bottom surface crosses vertical surfaces of the well portion above a maximum ascending water level of the pooled water surface during flushing.

9 Claims, 11 Drawing Sheets

(56) References Cited

FOREIGN PATENT DOCUMENTS

| | | | |
|---|---|---|---|
| JP | 2015-068164 | A | 4/2015 |
| JP | 2015-168994 | A | 9/2015 |
| JP | 2018-105048 | A | 7/2018 |
| JP | 2018-204195 | A | 12/2018 |
| JP | 2019-060210 | A | 4/2019 |
| JP | 2019-137994 | A | 8/2019 |
| JP | 2020-026681 | A | 2/2020 |
| JP | 2021-071009 | A | 5/2021 |
| JP | 2021-113497 | A | 8/2021 |
| JP | 2022-069675 | A | 5/2022 |
| JP | 2022-097731 | A | 6/2022 |
| JP | 2022-174250 | A | 11/2022 |
| WO | 2016/143029 | A1 | 9/2016 |

OTHER PUBLICATIONS

An Office Action; "Notice of Reasons for Refusal," mailed by the Japanese Patent Office on Aug. 5, 2024, which corresponds to Japanese Patent Application No. 2023-029577; resubmitted with English language translation.

An Office Action; "Notice of Reasons for Refusal," mailed by the Japanese Patent Office on Aug. 5, 2024, which corresponds to Japanese Patent Application No. 2023-029578; resubmitted with English language translation.

Decision to Grant a Patent; mailed by the Japanese Patent Office on Jul. 30, 2024, which corresponds to Japanese Patent Application No. 2023-029576.

An Office Action; mailed by the Japanese Patent Office on Aug. 5, 2024, which corresponds to Japanese Patent Application No. 2023-029577 and is related to U.S. Appl. No. 18/586,799.

An Office Action; mailed by the Japanese Patent Office on Aug. 5, 2024, which corresponds to Japanese Patent Application No. 2023-029578 and is related to U.S. Appl. No. 18/586,799.

An Office Action; "Notice of Reasons for Refusal," mailed by the Japanese Patent Office on Jul. 30, 2024, which corresponds to Japanese Patent Application No. 2023-029575 and is related to U.S. Appl. No. 18/586,799; with English language translation.

FLUSH TOILET

BACKGROUND OF THE INVENTION

Field of the Invention

The present invention relates to a flush toilet, and more particularly, to a flush toilet for discharging wastes with flush water supplied from a flush water supply source.

Description of the Related Art

Conventionally, there is known a flush toilet that comprises a bowl including a waste receiving surface, a rim formed on an upper portion of the waste receiving surface, and a well portion formed below the waste receiving surface and having a pooled water surface formed in the interior of the well portion, a first rim spouting port and a second rim spouting port that are formed in the rim and are configured to spout flush water, and a water discharge conduit connected to a bottom portion of the bowl.

Such a flush toilet is disclosed in, for example, Japanese Patent Application Laid-Open No. 2021-113497 (Patent Literature 1) and Japanese Patent Application Laid-Open No. 2018-204195 (Patent Literature 2). Patent Literature 1 discloses a flush toilet that includes a first rim spouting port and a second rim spouting port provided at the rear of the first rim spouting port so that flush water from the second rim spouting port is caused to flow directly into a pooled water surface. Furthermore, as in Patent Literature 1, Patent Literature 2 also discloses a flush toilet that includes a first rim spouting port and a second rim spouting port so that flush water distributed by a water supply distribution pipe is caused to flow directly from the second rim spouting port into a pooled water surface.

Incidentally, in a flush toilet, it is conceivable that a pooled water surface is formed to be large to reduce the area of a waste receiving surface which is a dry surface so that the adhesion of wastes to the bowl can be suppressed. Here, in the flush toilet as disclosed in the above-described Patent Literatures 1 and 2, since flush water from the second rim spouting port is caused to flow directly into the pooled water surface, flush water having strong force flows into a specific region of the pooled water surface. Therefore, in such a flush toilet, it has been found that when the pooled water surface is formed to be large, flush water having strong force flows into only a specific region of the pooled water surface, thereby disturbing a surface of the pooled water surface, which may make it impossible to sufficiently drain floating wastes floating on the surface of the pooled water surface.

As a result of eager study, the present inventors have conceived that in order to solve such a problem caused by forming the pooled water surface to be large, that is, in order to securely drain floating wastes floating on the pooled water surface, it is necessary to suppress the disturbance of the surface of the pooled water surface by making constant the pressing pressure applied on each region of the pooled water surface by flush water spouted from the rim spouting port. Therefore, in the flush toilet including the first rim spouting port and the second rim spouting port, one conceivable method for making constant the pressing pressure applied to each region of the pooled water surface is, for example, to increase an amount of flush water spouted from the second rim spouting port to cause the flush water to flow into the pooled water surface in an early stage.

However, when the amount of flush water spouted from the second rim spouting port is increased, the force of the flush water circulating on an inner circumference surface of the rim is increased, which makes it impossible to cause the flush water to flow into the pooled water surface in an early stage, resulting in delay of drainage timing of the floating wastes.

The present inventors found the problem caused by forming a pooled water surface to be large in a flush toilet, and have eagerly studied to solve this problem, and the present inventors have made the present invention.

The present invention has been made to solve the above-described problem and an object thereof is to provide a flush toilet which, even when an amount of flush water spouted from a second rim spouting port is increased, can cause the flush water from the second rim spouting port to flow into a pooled water surface in an early stage to advance drainage timing of floating wastes.

SUMMARY OF THE INVENTION

In order to achieve the above object, the present invention provides a flush toilet for discharging wastes with flush water supplied from a flush water supply source, the flush toilet comprising: a bowl including a waste receiving surface configured to receive wastes, a rim formed above the waste receiving surface and having an inner circumference surface, and a well portion formed below the waste receiving surface and having a pooled water surface formed in the well portion; a first spout part having a first rim spouting port provided in the rim and formed to spout flush water forward along the inner circumference surface of the rim; a first water conduit configured to supply flush water supplied from the flush water supply source to the first spout part; a second spout part having a second rim spouting port provided in the rim and formed to spout flush water rearward along the inner circumference surface of the rim; a second water conduit configured to supply flush water supplied from the flush water supply source to the second spout part; and a water discharge conduit connected to a bottom portion of the bowl, wherein a bottom surface of the second water conduit is configured to be inclined downward along a water spouting direction of the flush water spouted from the second rim spouting port, and such that an extension line of the bottom surface crosses vertical surfaces of the well portion above a maximum ascending water level of the pooled water surface during flushing.

In the present invention configured as described above, since the bottom surface of the second water conduit is configured to be inclined downward along the water spouting direction of the flush water spouted from the second rim spouting port, and such that the extension line of the bottom surface crosses the vertical surfaces of the well portion above the maximum ascending water level of the pooled water surface during flushing, the flush water spouted from the second rim spouting port can be caused to flow into the pooled water surface in an early stage, and furthermore, the flush water can be caused to flow into the pooled water so as to be poured from above the ascended pooled water surface. According to the present invention, this can form a vertical circulating flow in the well portion, and advance the drainage timing of floating wastes.

In the present invention, preferably, an upper surface of the second water conduit is inclined downward from upstream toward downstream.

In the present invention configured as described above, since an upper surface of the second water conduit is inclined downward from upstream toward downward, the flush water spouted from the second rim spouting port can be spouted toward the pooled water surface.

In the present invention, preferably, the upper surface of the second water conduit includes an upstream-side upper surface that is inclined downward at a first inclination angle, and a downstream-side upper surface that is inclined downward at a second inclination angle gentler than the first inclination angle.

In the present invention configured as described above, since the upper surface of the second water conduit includes an upstream-side upper surface that is inclined downward at a first inclination angle, and a downstream-side upper surface that is inclined downward at a second inclination angle gentler than the first inclination angle, the flush water supplied to the second water conduit flows downward in a state in which a pressure loss is suppressed by the upstream-side upper surface, and is spouted from the second rim spouting port in a state in which the flow is adjusted by the downstream-side upper surface. According to the present invention, this enables the flush water spouted from the second rim spouting port to be vigorously spouted toward the pooled water surface.

In the present invention, preferably, the second rim spouting port is formed to be directed toward the pooled water surface.

In the present invention configured as described above, since the second rim spouting port is formed to be directed toward the pooled water surface, the flush water spouted from the second rim spouting port can be spouted toward the pooled water surface.

In the present invention, preferably, the second water conduit has a flow channel cross section in which a lower corner on an outer side and a lower corner on an inner side are formed with the same curvature radius.

In the present invention configured as described above, since the second water conduit has a flow channel cross section in which a lower corner on an outer side and a lower corner on an inner side are formed with the same curvature radius, the flush water spouted from the second rim spouting port can be vigorously spouted toward the pooled water surface without disturbance of the flush water in the second water conduit.

In the present invention, preferably, the second rim spouting port is configured in which, in a front view, a lower corner on an outer side of the second rim spouting port is formed with a first curvature radius, and a lower corner on an inner side of the second rim spouting port is formed with a second curvature radius, and the first curvature radius is further formed to be larger than the second curvature radius.

In the present invention configured as described above, since the second rim spouting port is configured in which, in a front view, a lower corner on an outer side of the second rim spouting port is formed with a first curvature radius, and a lower corner on an inner side of the second rim spouting port is formed with a second curvature radius, and the first curvature radius is further formed to be larger than the second curvature radius, the flush water spouted from the second rim spouting port can be caused to flow into the pooled water surface even when an amount of flush water spouted from the second rim spouting port is increased.

In the present invention, preferably, the bowl on a downstream side of the second rim spouting port is formed continuously with the lower corner on the outer side of the second rim spouting port, and is formed with each curvature radius gradually increasing from the first curvature radius toward a water spouting direction of the flush water.

In the present invention configured as described above, since the bowl on a downstream side of the second rim spouting port is formed continuously with the lower corner on the outer side of the second rim spouting port, and is formed with each curvature radius gradually increasing from the first curvature radius toward a water spouting direction of the flush water, most of the flush water spouted from the second rim spouting port can be guided to the pooled water surface.

In the present invention, preferably, the bowl further includes a shelf formed between the waste receiving surface and the rim, and extending along the rim from a second spouting port, and the shelf is formed to extend from a first portion which is located on an outer side in a width direction in the second spouting port, but is not formed in a second portion other than the first portion, the second portion being located on an inner side in the width direction in the second spouting port.

In the present invention configured as described above, the shelf in the bowl is formed to extend from a first portion which is located on an outer side in a width direction in the second spouting port (in other words, on a rear side (side opposite to the pooled water surface) in the second spouting port), but is not formed in a second portion other than the first portion, the second portion being located on an inner side in the width direction in the second spouting port (in other words, on a front side (pooled water surface side) in the second spouting port). Therefore, the flush water spouted from the second spouting port is distributed into the flush water flowing out through the first portion of the second spouting port and the flush water flowing out through the second portion of the second spouting port.

Thus, the flush water flowing out through the second portion of the second spouting port flows directly into the pooled water surface. This enables a part of the flush water spouted from the second spouting port to flow into the pooled water surface in an early stage. As a result, it is possible to suppress the disturbance of the surface of the pooled water surface by making constant the pressing pressure applied on each region of the pooled water surface by the flush water, and secure drainage of the floating wastes. On the other hand, the flush water having flowed out through the first portion of the second spouting port flows on the shelf along the rim, and then circulates on the waste receiving surface and flows into the pooled water surface. This enables flushing on the waste receiving surface to be secured by a part of the flush water spouted from the second spouting port (remaining flush water other than the flush water flowing out through the second portion).

As described above, according to the present invention, both of drainage of floating wastes and flushing on the waste receiving surface can be secured.

In the present invention, preferably, an enlarged part, in which a space enlarging along the water spouting direction from the second rim spouting port is formed, is provided above a downstream side of the second rim spouting port of the rim.

In the present invention configured as described above, since an enlarged part in which a space enlarging along the water spouting direction from the second rim spouting port is formed is provided above a downstream side of the second rim spouting port of the rim, air drained from the second rim spouting port is accumulated in the space of the enlarged part and an air pressure is generated, and therefore, even though splashing or dripping of the water occurs when the flush water from the second rim spouting port is spouted, splashing and dripping of the water can be suppressed by the air pressure generated in the space of the enlarged part.

According to the flush toilet of the present invention, even when an amount of flush water spouted from a second rim spouting port is increased, the flush water from the second rim spouting port can be caused to flow into a pooled water surface in an early stage to advance drainage timing of floating wastes.

DETAILED DESCRIPTION OF THE PREFERRED EMBODIMENTS

Hereinafter, a flush toilet according to an embodiment of the present invention will be described with reference to the drawings.

Figure 1:
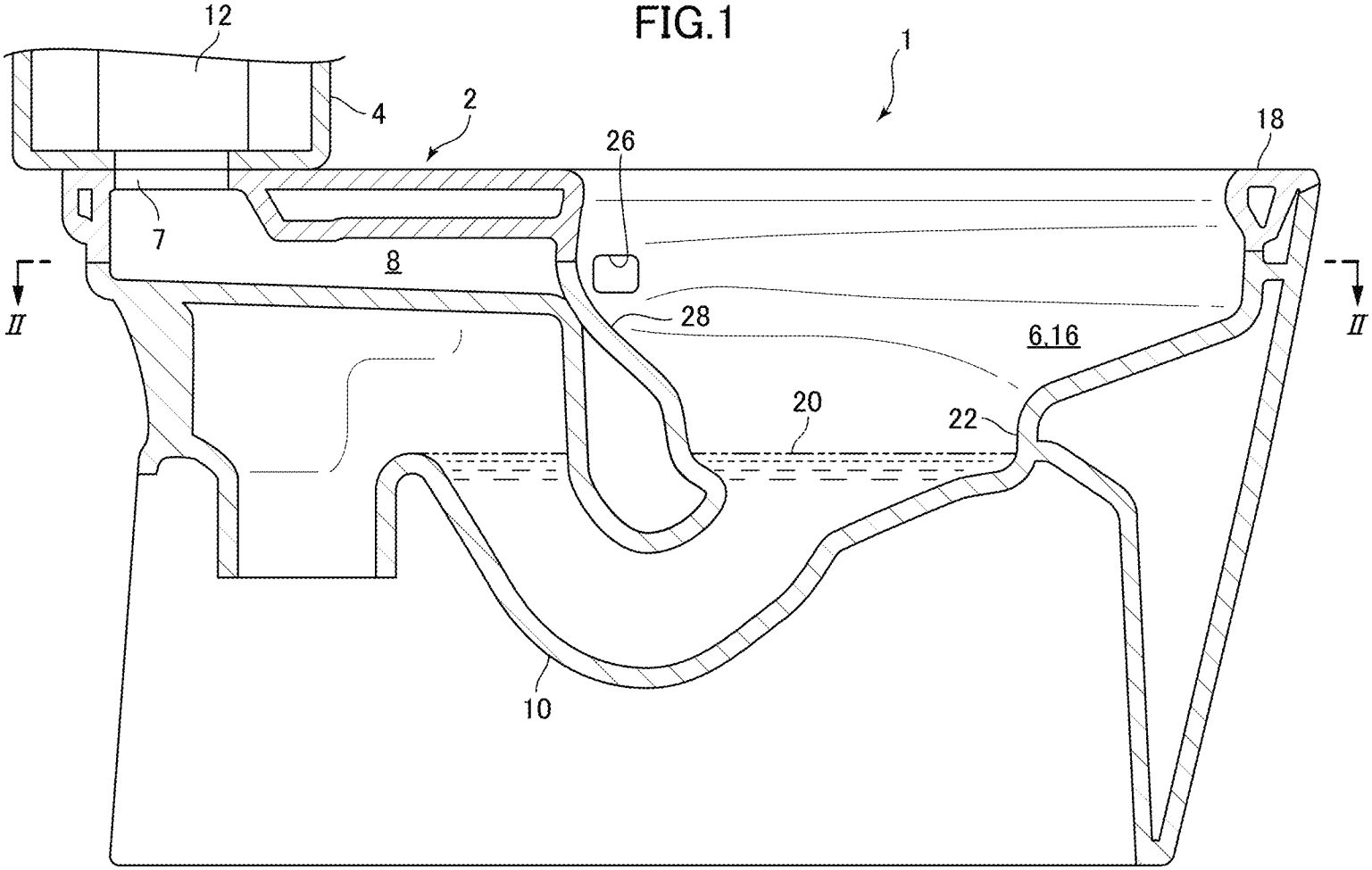
FIG. 1 is a vertical sectional view of a flush toilet according to an embodiment of the present invention.

First, a basic structure of a flush toilet according to the present embodiment will be described with reference to FIGS. 1 to 3. FIG. 1 is a vertical sectional view of the flush toilet according to an embodiment of the present invention, FIG. 2 is a sectional plan view as viewed along line II-II in FIG. 1, and FIG. 3 is a partial enlarged view illustrating a second rim spouting port in FIG. 2 and its surroundings.

Note that, in the present specification, the following description will be made on the assumption that, as seen from a user, a side closer to the user is referred to as a front side, a back side is referred to as a rear side, a right side is referred to as a right side, and a left side is referred to as a left side.

Figure 2:
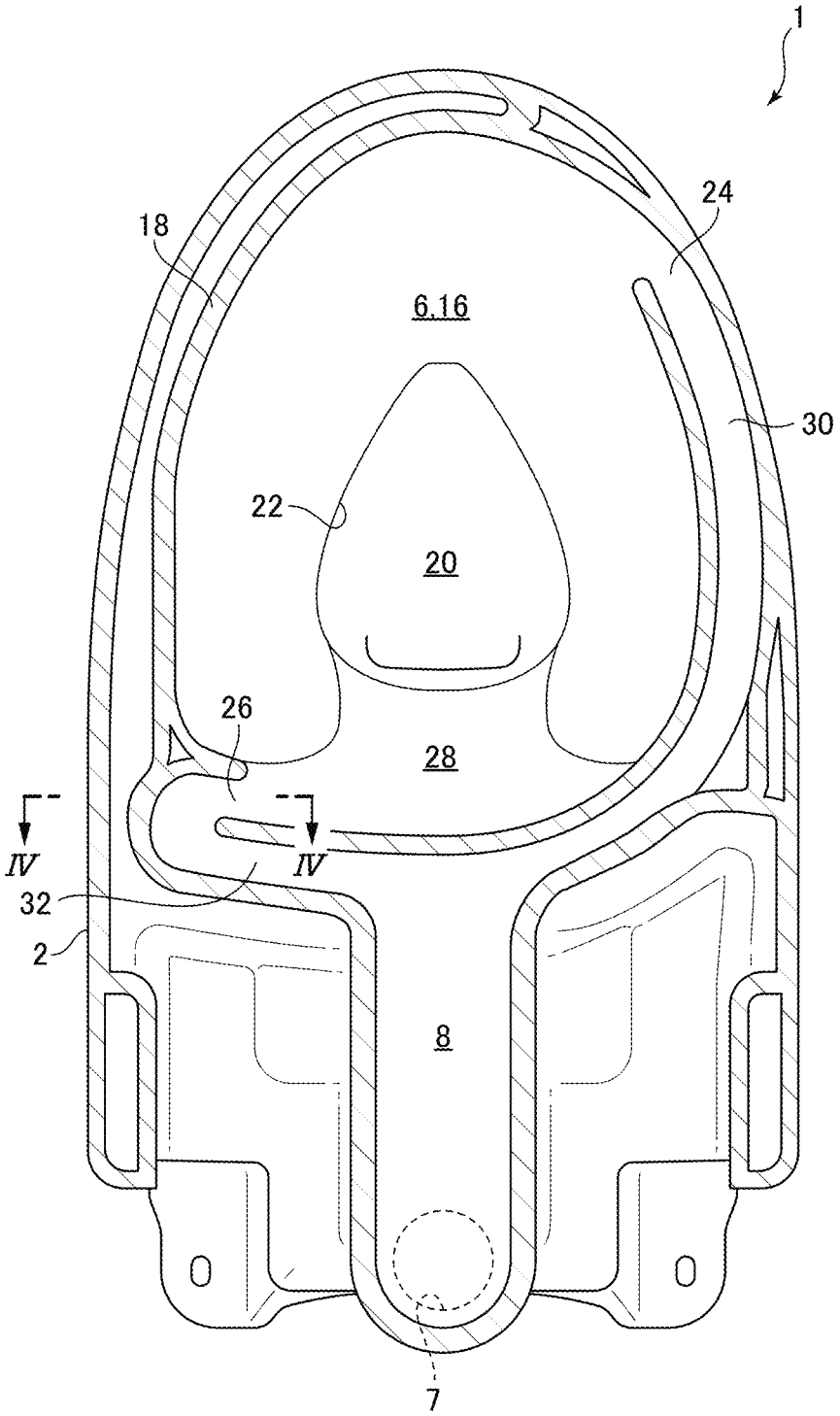
FIG. 2 is a sectional plan view as viewed along line II-II in FIG. 1.
Figure 3:
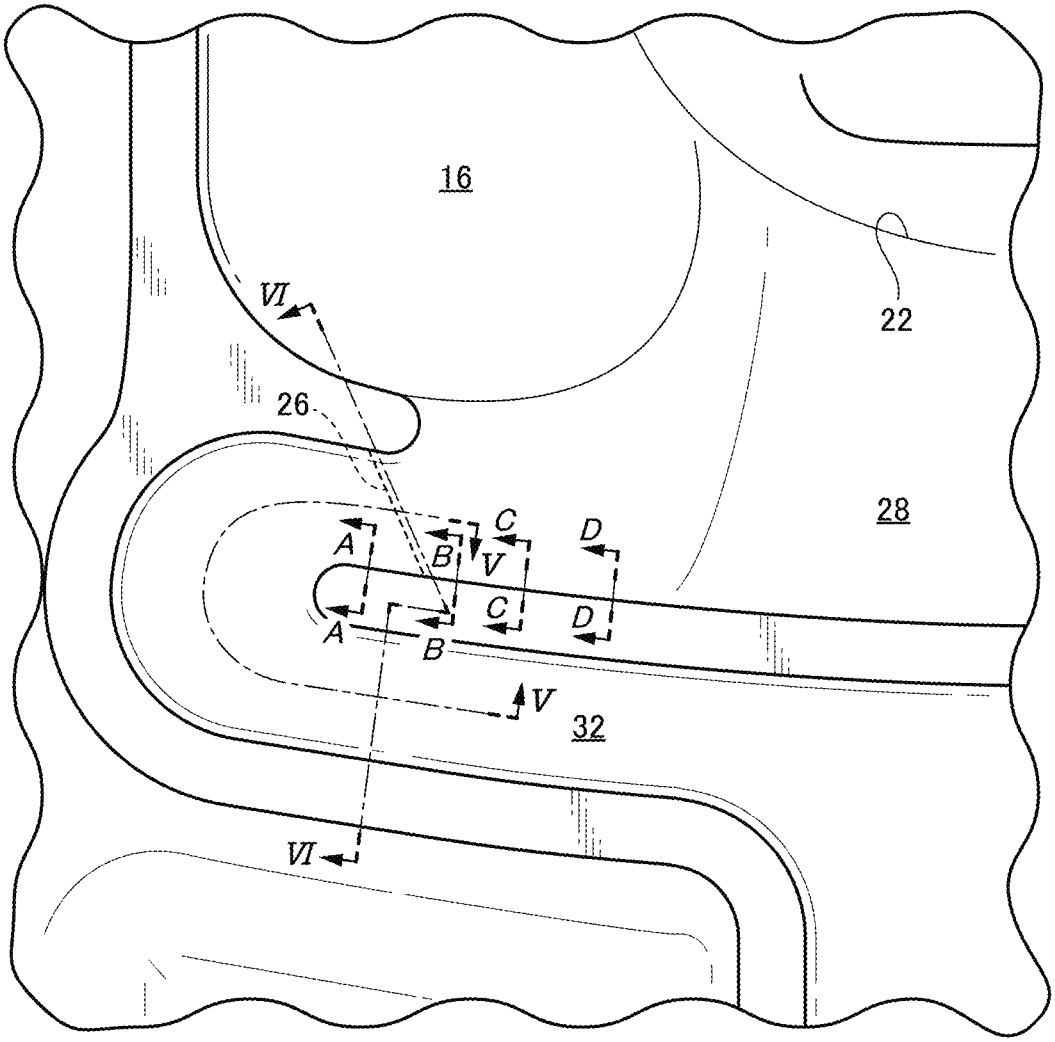
FIG. 3 is a partial enlarged view illustrating a second rim spouting port in FIG. 2 and its surroundings.

As illustrated in FIGS. 1 to 3, a flush toilet 1 is an under-floor drainage type flush toilet that is provided in the floor. The flush toilet 1 is a wash-down type toilet that pushes away wastes by the action of running water caused by a difference in a water level inside a bowl.

The flush toilet 1 includes a toilet main body 2 made of ceramics, and a storage tank 4 that supplies flush water for flushing the toilet main body 2 and stores the flush water therein. The toilet main body 2 includes a bowl 6 on a front side, and a common water passageway 8 formed in a rear upper portion, the common water passageway 8 being provided with an opening 7 at its upstream end so that the opening 7 communicates with the storage tank 4. Furthermore, a water discharge conduit 10 for draining wastes is formed in a rear lower portion of the bowl 6.

The above-described storage tank 4 includes a discharge valve 12, and is configured so that when a user performs an opening operation on an operation lever (not illustrated), the discharge valve 12 opens, and flush water in the storage tank 4 is supplied to the toilet main body 2, and is spouted from a first rim spouting port 24 and a second rim spouting port 26 which will be described later.

In the present embodiment, instead of the storage tank 4, it is acceptable to use a tap water direct connection system or to use a flush valve system, as a flush water supply source. Alternatively, the flush water may be supplied using a pump.

Note that the flush toilet 1 is a wash-down type toilet, but may be a siphon type flush toilet that drains wastes in the bowl 6 from the water discharge conduit to the outside by means of a siphon action.

The bowl 6 of the toilet main body 2 includes a bowl-shaped waste receiving surface 16, a rim 18 formed above the waste receiving surface 16 and having an inner circumference surface, and a well portion 22 formed below the waste receiving surface 16 and having a pooled water surface 20 formed therein. The pooled water surface 20 of the well portion 22 has a substantially triangular shape with a size of 160 mm to 180 mm in a front and rear direction and 125 mm to 145 mm in a width direction as viewed from above, and is formed to be larger (more enlarged) than a pooled water surface of a conventional flush toilet. The well portion 22 includes a vertical surface 22*a*, and forms a substantially triangular shape, which is more ovoid (an elliptical shape in which a front side is tapered) than the pooled water surface 20, with a size of 200 mm to 240 mm in the front and rear direction and 150 mm to 190 mm in a lateral direction as viewed from above, for example.

In the rim 18 in the bowl 6, the first rim spouting port 24 that spouts flush water is formed on a left-side front side as viewed from the front, and the second rim spouting port 26 that spouts flush water is formed on a right-side rear side as viewed from the front (see FIGS. 2 and 3). Specifically, the first rim spouting port 24 is provided at a further front side rather than a front end of the pooled water surface 20, and the second rim spouting port 26 is provided at a further rear side rather than a rear end of the pooled water surface 20. In the bowl 6, a concave portion 28 extending from such a second rim spouting port 26 is further formed (FIGS. 1 to 3).

The above-described common water passageway 8 branches into a first water conduit 30 and a second water conduit 32 toward a downstream side, the first water conduit 30 extending to the first rim spouting port 24, the second water conduit 32 extending to the second rim spouting port 26, so that the flush water stored in the storage tank 4 is supplied to the first rim spouting port 24 and the second rim spouting port 26. Herein, the first rim spouting port 24 and the second rim spouting port 26 are adapted to spout flush water in a direction of forming a circulating flow which circulates in the same direction. In the present embodiment, a counterclockwise circulating flow is formed.

Figure 4:
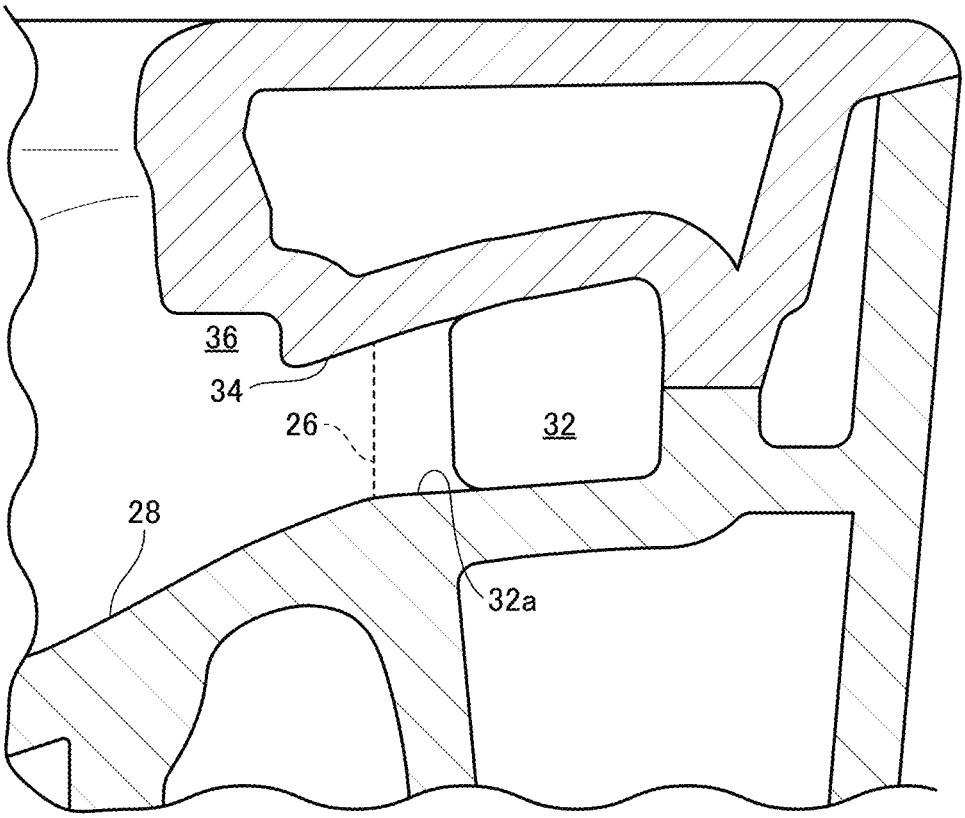
FIG. 4 is a partial sectional view as viewed along line IV-IV in FIG. 2.

Next, the structure on the downstream side of the second rim spouting port 26 will be described with reference to FIG. 4. FIG. 4 is a partial sectional view as viewed along line IV-IV in FIG. 2.

As illustrated in FIG. 4, a bottom surface 32*a* of the second water conduit 32 extends in a substantially flat surface, while the concave portion 28 in the bowl 6 on the downstream side of the second rim spouting port 26 has a curved shape formed in an arc shape. A portion extending vertically upward from a boundary between the bottom surface 32*a* of the second water conduit 32 and the curved shape of the concave portion 28 serves as the second rim spouting port 26. The second rim spouting port 26 is indicated by a dashed line in FIG. 4. Furthermore, the second rim spouting port 26 is inclined inward in plan view as indicated by a dashed line in FIG. 3 and is directed toward the pooled water surface 20 as described later.

As illustrated in FIG. 4, an upper surface 34 extending in a downward inclined manner along the water spouting direction continuously from an upper end of the second rim spouting port 26 is formed on the downstream side of the second rim spouting port 26 of the rim 18. An enlarged part 36 in which a space enlarging upward along the water spouting direction of the second rim spouting port 26 is formed is formed on the downstream side of the upper surface 34.

Figure 5:
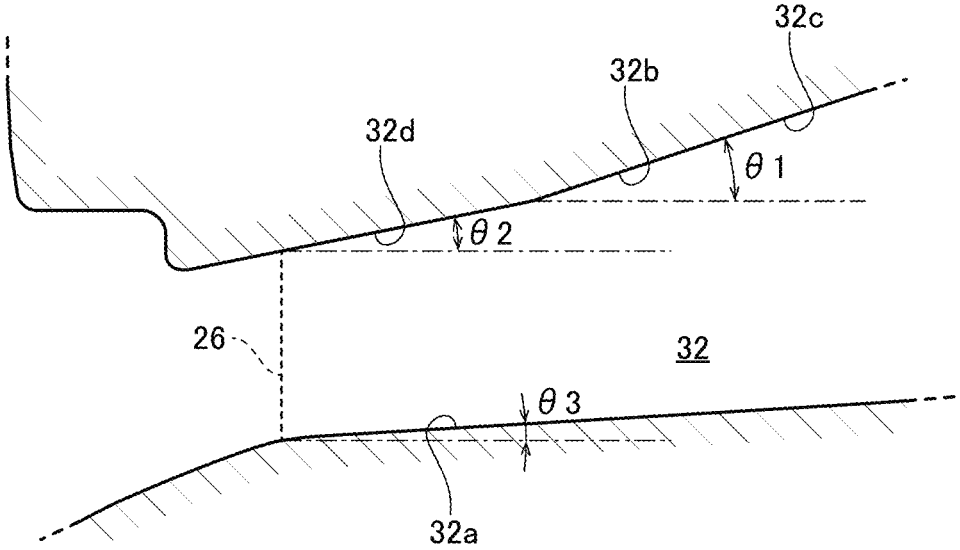
FIG. 5 is a partial sectional view of a second water conduit, as viewed along line V-V in FIG. 3.

Next, the second water conduit 32 will be described with reference to FIG. 5. FIG. 5 is a partial sectional view of a second water conduit, as viewed along line V-V in FIG. 3.

As illustrated in FIG. 5, the second water conduit 32 includes a lower surface 32*a* and an upper surface 32*b*. The upper surface 32*b* includes an upstream-side upper surface 32*c* and a downstream-side upper surface 32*d*, and the upstream-side upper surface 32*c* is inclined downward by an angle θ1 which is a first inclination angle, from the upstream toward the downstream, and the downstream-side upper surface 32*d* is inclined downward by an angle θ2 which is a second inclination angle, from the upstream toward the downstream. Herein, the second inclination angle θ2 is preferably in a range from 20 degrees to 60 degrees, and further, most preferably 30 degrees, with respect to the horizontal direction. On the other hand, the lower surface 32*a* is inclined downward by an angle θ3 from the upstream toward the downstream. These inclination angles are formed to satisfy the relationship of θ1>θ2>θ3.

In this way, in the present embodiment, the upper surface 32*b* of the second water conduit 32 is inclined more downward than the bottom surface 32*a* of the second water conduit 32, from the upstream toward the downstream. Furthermore, the upper surface 32*b* of the second water conduit 32 includes the upstream-side upper surface 32*c* inclined downward by the first inclination angle θ1 from the upstream toward the downstream, and the downstream-side upper surface 32*d* inclined downward by the second inclination angle θ2, which is gentler than the first inclination angle θ1, from the upstream toward the downstream.

Figure 6:
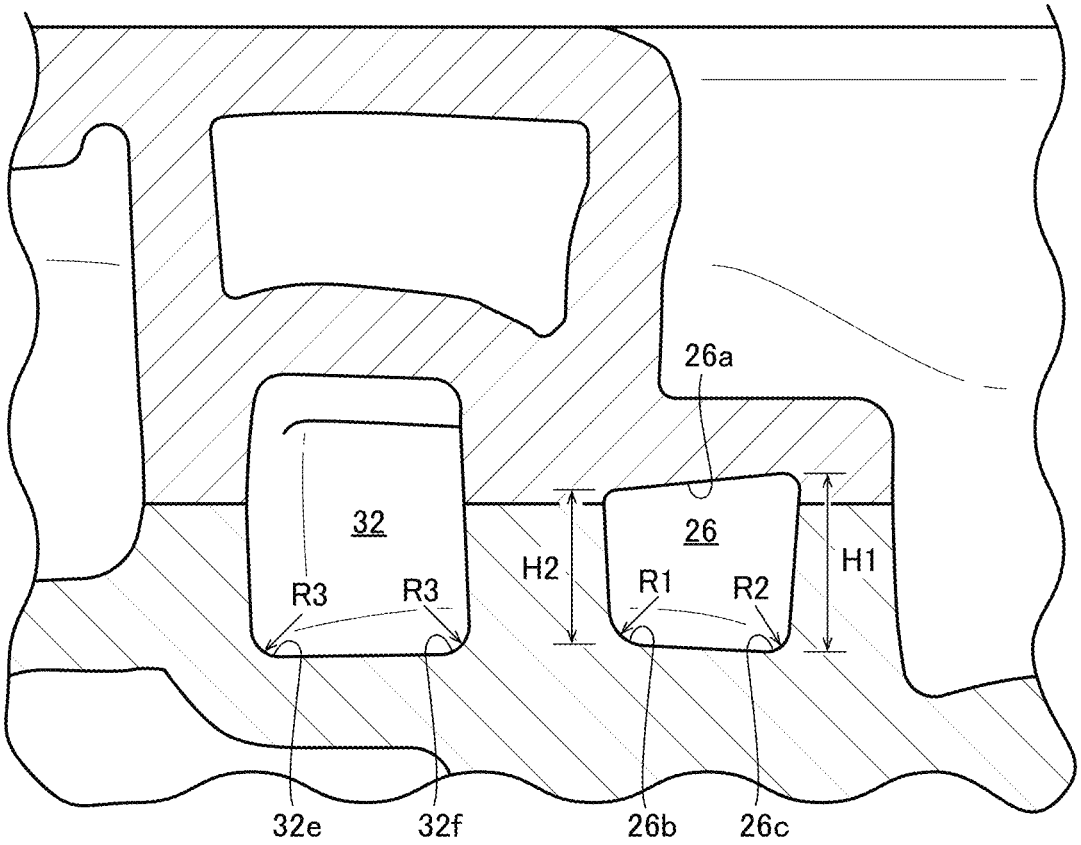
FIG. 6 is a sectional view illustrating a shape of the second rim spouting port and a sectional shape of the second water conduit, as viewed along line VI-VI in FIG. 3.

Next, a shape of the second rim spouting port and a sectional shape of the second water conduit will be described with reference to FIG. 6. FIG. 6 is a sectional view illustrating a shape of the second rim spouting port and a sectional shape of the second water conduit, as viewed along line VI-VI in FIG. 3.

As illustrated in FIG. 6, the second rim spouting port 26 has a substantially rectangular shape in a front view, and is further configured in which an upper end (upper surface) 26*a* thereof extends in a downward inclined manner from the inner side toward the outer side, and a height H1 on the inner side of the second rim spouting port 26 is further formed to be larger than a height H2 on the outer side thereof.

Furthermore, as illustrated in FIG. 6, in the second rim spouting port 26, in a front view, a lower corner 26*b* on an outer side thereof is formed with a first curvature radius R1, and a lower corner 26*c* on an inner side thereof is formed with a second curvature radius R2. Further, the first curvature radius R1 is formed to be larger than the second curvature radius R2 (R1>R2).

As illustrated in FIG. 6, the second water conduit 32 has a flow channel cross section in which a lower corner 32*e* on an outer side thereof and a lower corner 32*f* on an inner side thereof are formed with the same curvature radius R3.

Figure 7:
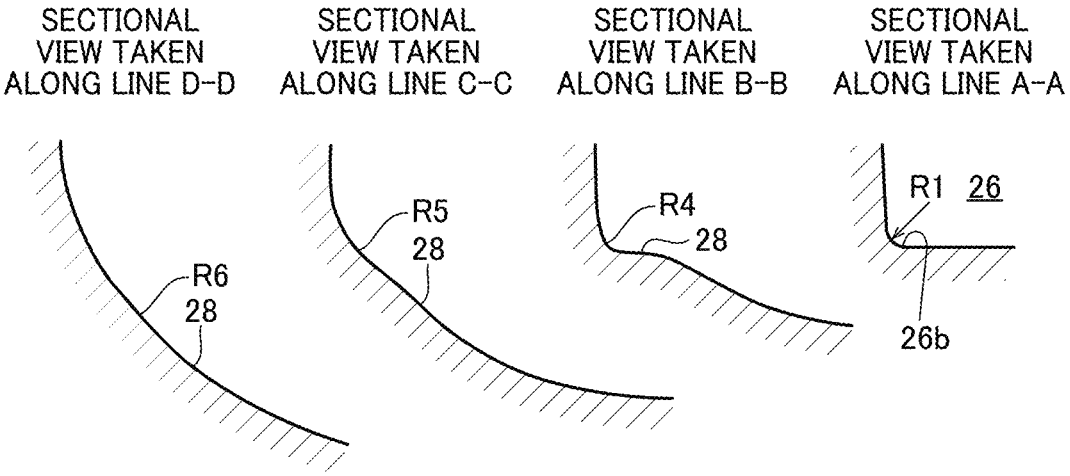
FIG. 7 is each partial sectional view as viewed along lines A-A, B-B, C-C, and D-D in FIG. 3.

Next, the relationship between a shape of the second rim spouting port 26 and a shape of the concave portion 28 in the bowl 6 on the downstream side of the second rim spouting port 26 will be described with reference to FIG. 7. FIG. 7 is each partial sectional view as viewed along lines A-A, B-B, C-C, and D-D in FIG. 3.

In FIG. 7, a sectional view taken along line A-A illustrates a shape of a lower portion on the inner side of the second rim spouting port 26, and each sectional view taken along lines B-B, C-C, and D-D illustrates a sectional shape (surface shape) of the concave portion 28 in the bowl 6 on the downstream side of the second rim spouting port 26.

As illustrated in FIG. 7, in the present embodiment, the concave portion 28 in the bowl 6 on the downstream side of the second rim spouting port 26 is formed continuously with the lower corner 26*b* on the outer side of the second rim spouting port 26, and is formed with each curvature radius R4, R5, R6 gradually increasing from the first curvature radius R1 of the lower corner 26*b* on the outer side of the above-described second rim spouting port 26 toward a water spouting direction. Note that each of the curvature radii R4, R5, and R6 is an average value of a plurality of curvature radii.

Figure 8:
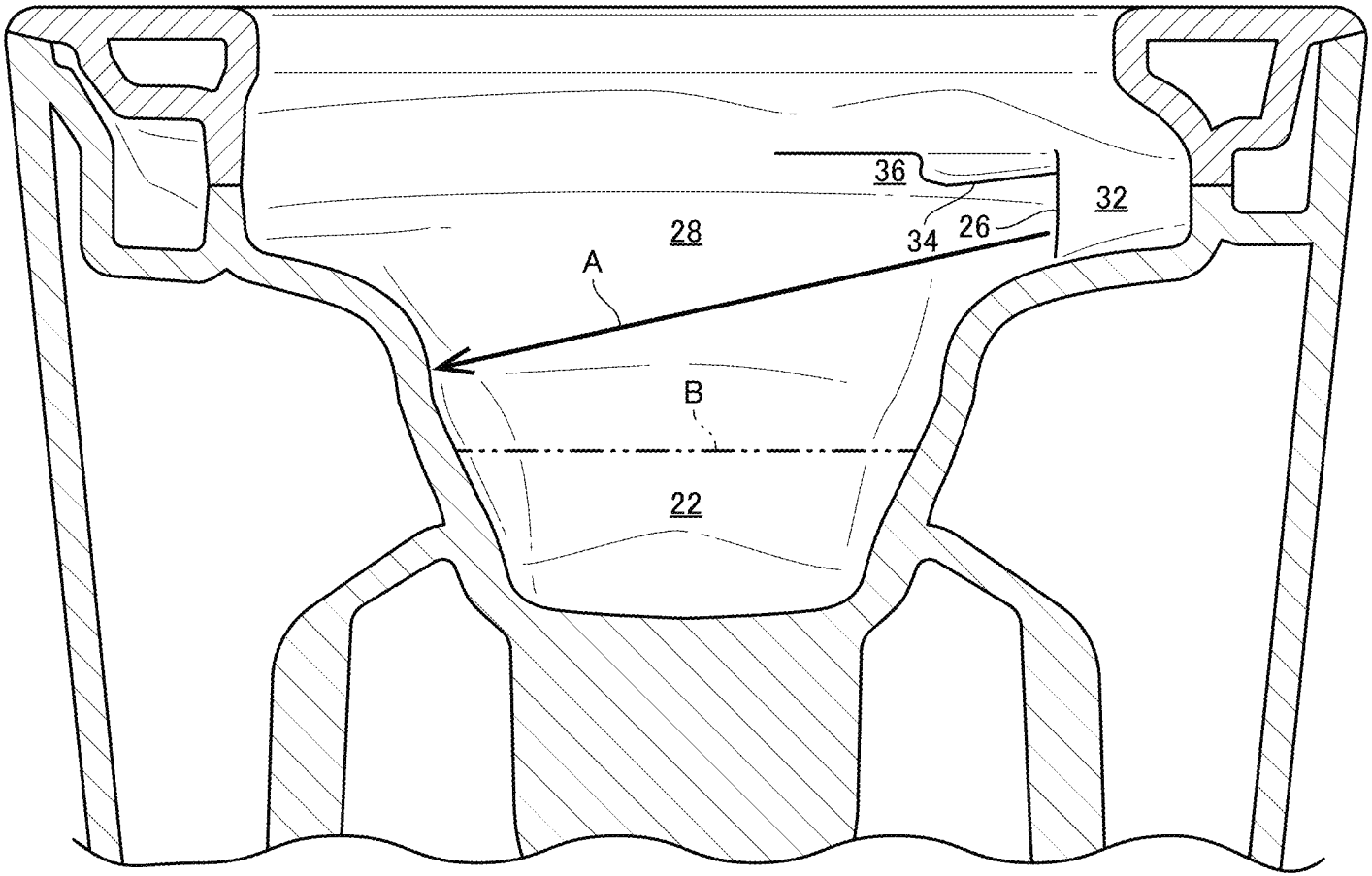
FIG. 8 is a partial sectional view as viewed from a front of a bowl of the flush toilet according to the embodiment of the present invention.

Next, the water spouting direction of flush water from the second rim spouting port 26 in the present embodiment will be described with reference to FIGS. 8 and 9. FIG. 8 is a partial sectional view as viewed from a front of the bowl 6 of the flush toilet according to the present embodiment, and FIG. 9 is a partial perspective view of the bowl 6 of the flush toilet according to the present embodiment, as viewed obliquely from the front and above.

Figure 9:
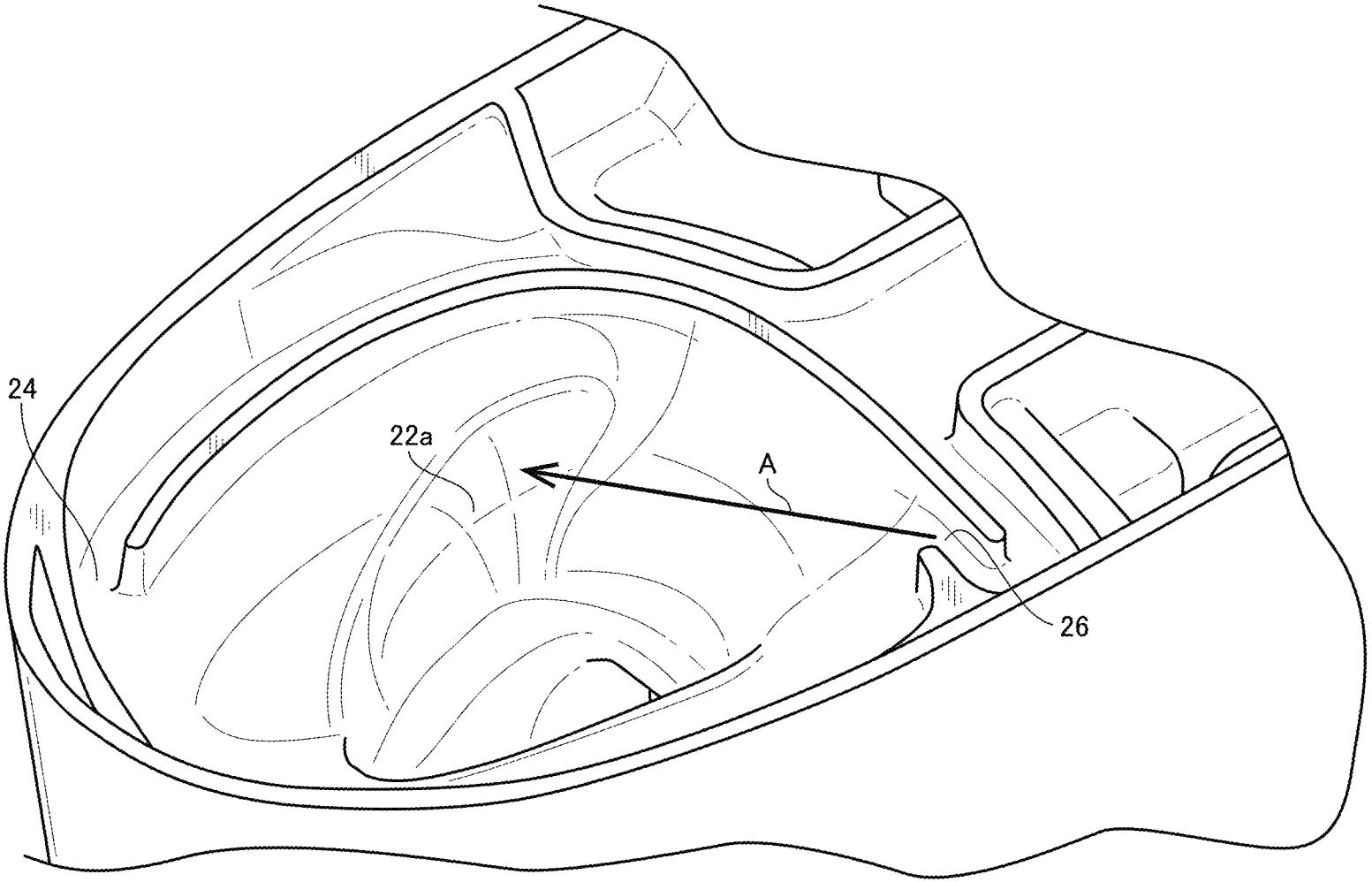
FIG. 9 is a partial perspective view of the bowl of the flush toilet according to the embodiment of the present invention, as viewed obliquely from the front and above.

As illustrated in FIGS. 8 and 9, the bottom surface 32*a* of the second water conduit 32 on the upstream side of the second rim spouting port 26 is inclined downward by the angle θ3 from the upstream toward the downstream, as described above. In the present embodiment, an extension line A of the bottom surface 32*a* inclined downward in the second water conduit 32 crosses vertical surfaces 22*a* on both sides of the well portion 22 above a maximum ascending water level B of the pooled water surface 20 during flushing.

As illustrated in FIGS. 3 and 9, the second rim spouting port 26 is formed to be directed toward a left-side vertical surface 22*a* of the well portion 22 which is located on a side opposite to the second rim spouting port 26.

The above-described flush toilet 1 according to the present embodiment is a toilet that includes the first rim spouting port 24 and the second rim spouting port 26 which are provided in the rim 18, and performs a flushing operation with only flush water supplied from each rim spouting port. However, the present embodiment can be applied to a flush toilet that performs, for example, a jet water spout, as a flush water spout from a spouting port other than the rim spouting port.

Next, an action and an effect of the flush toilet 1 according to the present embodiment will be described.

First, in the flush toilet 1 according to the present embodiment, since the enlarged part 36 in which a space enlarging along the water spouting direction from the second rim spouting port 26 is formed is provided above the downstream side of the second rim spouting port 26 of the rim 18, air drained from the second rim spouting port 26 is accumulated in the space of the enlarged part 36 and an air pressure is generated, and therefore, even though splashing or dripping of the water occurs when the flush water from the second rim spouting port 26 is spouted, splashing and dripping of the water can be suppressed by the air pressure generated in the space of the enlarged part 36.

In the flush toilet 1 according to the present embodiment, since the upper surface 34 extending in the water spouting direction continuously from an upper end of the second rim spouting port 26 is provided between the enlarged part 36 and the second rim spouting port 26 of the rim 18, the flush water that is spouted from the second rim spouting port 26 and flows upward can be guided in the water spouting direction by the upper surface 34 of the rim 18, and splashing and dripping of the water can be further suppressed.

In the flush toilet 1 according to the present embodiment, since the upper surface 32*b* of the second water conduit 32 is inclined more downward than the bottom surface 32*a* of the second water conduit 32, from the upstream toward the downstream, the flush water spouted from the second rim spouting port 26 can flow into the pooled water surface in an earlier stage.

In the flush toilet 1 according to the present embodiment, since the upper surface 32*b* of the second water conduit 32 includes the upstream-side upper surface 32*c* that is inclined downward at a first inclination angle θ1, and the downstream-side upper surface 32*d* that is inclined downward at a second inclination angle θ2 gentler than the first inclination angle θ1, the flush water supplied to the second water conduit 32 flows downward in a state in which a pressure loss is suppressed by the upstream-side upper surface 32*c*, and is spouted from the second rim spouting port 26 in a state in which the flow is adjusted by the downstream-side upper surface 32*d*. According to the present embodiment, this can further suppress splashing and dripping of the water, and enables the flush water spouted from the second rim spouting port 26 to flow into the pooled water surface in an earlier stage.

In the flush toilet 1 according to the present embodiment, since the second inclination angle θ2 of the downstream-side upper surface 32*d* of the second water conduit 32 is in a range from 20 degrees to 60 degrees with respect to the horizontal direction, the downstream-side upper surface 32*d* of the second water conduit 32 can be used to adjust the flow in a state in which a pressure loss is suppressed and further suppress splashing and dripping of the water.

In the flush toilet 1 according to the present embodiment, since the second rim spouting port 26 has, in a front view, the upper end that extends in a downward inclined manner from the inner side toward the outer side, and the height H1 on the inner side of the second rim spouting port 26 is further formed to be larger than the height H2 on the outer side thereof, it becomes easy to form the flow of the flush water flowing from the second rim spouting port 26 into the pooled water surface 20. Since the height H2 on the outer side of the second rim spouting port 26 is lower than the height H1 on the inner side thereof, it becomes easy to form the space of the enlarged part 36 on the outer side of the second rim spouting port 26. According to the present embodiment, these can further suppress splashing and dripping of the water while forming the flow of the flush water flowing into the pooled water surface 20.

In a conventional flush toilet, a lower corner on an outer side of a second rim spouting port and a lower corner on an inner side thereof have the same curvature radius, and flush water spouted from the second rim spouting port only circulates on the inner circumference surface of the rim.

However, in the present embodiment, the second rim spouting port 26 is configured in which, in a front view, the lower corner 26*b* on the outer side thereof is formed with the first curvature radius R1, and the lower corner 26*c* on the inner side thereof is formed with the second curvature radius R2, and the first curvature radius R1 is further formed to be larger than the second curvature radius R2. Therefore, on the outer side of the second rim spouting port 26, due to the corner 26*b* having a large curvature radius, a flow having energy with which the flush water runs up the concave portion 28 in the bowl 6 and is dropped into the pooled water surface 20 is formed. Furthermore, on the inner side of the second rim spouting port 26, due to the corner 26*c* having a small curvature radius, a gentle flow in which the flush water runs up less than the outer side of the second rim spouting port 26 can be spouted toward the pooled water surface 20. Accordingly, even when an amount of flush water spouted from the second rim spouting port 26 is increased, the flush water spouted from the second rim spouting port 26 can be caused to flow into the pooled water surface 20.

In the flush toilet 1 according to the present embodiment, since the second water conduit 32 has a flow channel cross section in which the lower corner 32*e* on the outer side and the lower corner 32*f* on the inner side are formed with the same curvature radius R3, the flush water can flow toward the second rim spouting port 26 without disturbance of the flush water in the second water conduit 32.

In the flush toilet 1 according to the present embodiment, since the bowl 6 on the downstream side of the second rim spouting port 26 is formed continuously with the lower corner 26*b* on the outer side of the second rim spouting port 26, and is formed with each curvature radius (R4, R5, R6) gradually increasing from the first curvature radius R1 toward the water spouting direction of the flush water, most of the flush water spouted from the second rim spouting port 26 can be guided to the pooled water surface.

In the flush toilet 1 according to the present embodiment, since the upper surface 32*b* of the second water conduit 32 is inclined downward from the upstream toward the downstream, the flush water spouted from the second rim spouting port 26 can be spouted toward the pooled water surface 20.

In the flush toilet 1 according to the present embodiment, since the bottom surface 32*a* of the second water conduit 32 is configured to be inclined downward along the water spouting direction of the flush water spouted from the second rim spouting port 26, and such that the extension line A of the bottom surface 32*a* crosses the vertical surfaces 22*a* of the well portion 22 above the maximum ascending water level B of the pooled water surface 20 during flushing, the flush water spouted from the second rim spouting port 26 can be caused to flow into the pooled water surface 20 in an early stage, and furthermore the flush water can be caused to flow into the pooled water so as to be poured from above the ascended pooled water surface 20. According to the present invention, this can form a vertical circulating flow in the well portion 22, and advance the drainage timing of floating wastes.

In the flush toilet 1 according to the present embodiment, since the second rim spouting port 26 is formed to be directed toward the pooled water surface 20, the flush water spouted from the second rim spouting port 26 can be spouted toward the pooled water surface 20.

Next, a flush toilet according to another embodiment of the present invention will be described.

Figure 10:
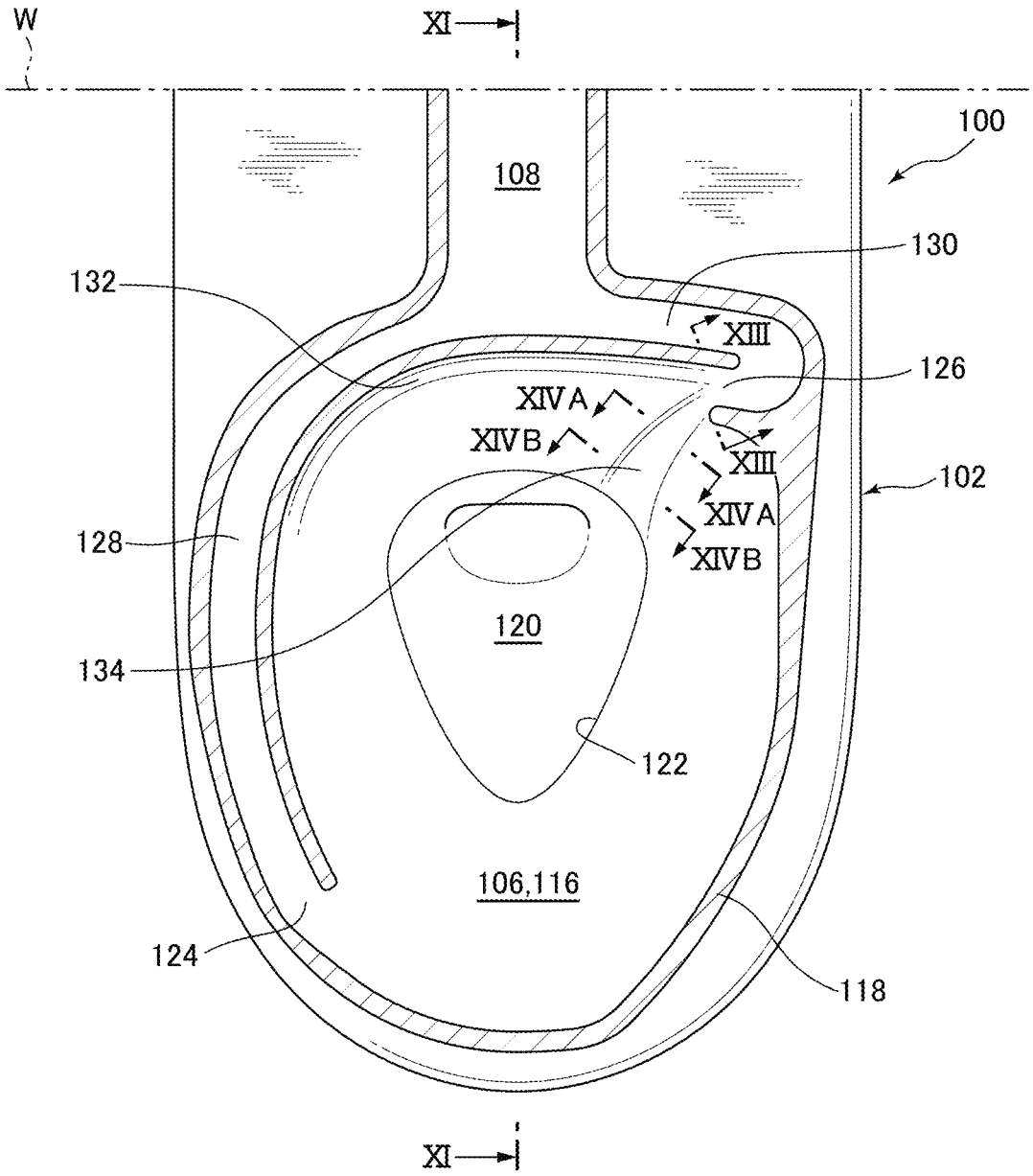
FIG. 10 is a sectional plan view of a flush toilet according to another embodiment of the present invention.

First, a basic structure of the flush toilet according to another embodiment will be described with reference to FIGS. 10 to 12. FIG. 10 is a sectional plan view of the flush toilet according to another embodiment, FIG. 11 is a vertical sectional view of the flush toilet according to another embodiment, as viewed along line XI-XI in FIG. 10, and FIG. 12 is a sectional perspective view of a part of the flush toilet according to another embodiment, as viewed obliquely from above.

As illustrated in FIG. 10, a flush toilet 100 is a so-called wall-hung flush toilet in which the rear side thereof is fixed to a wall surface W. As illustrated in FIGS. 10 and 11, the flush toilet 100 is a wash-down type toilet that pushes away wastes by the action of running water caused by a difference in a water level inside a bowl. The flush toilet 100 includes a toilet main body 102 made of ceramics, and a flush water supply source (not illustrated) that supplies flush water for flushing the toilet main body 102. The toilet main body 102 includes a bowl 106 on a front side, and a common water passageway 108 formed on a rear side, the common water passageway 108 communicating with the flush water supply source. Furthermore, a water discharge conduit 110 for draining wastes is formed in a rear lower portion of the bowl 106 (see FIG. 11). As the flush water supply source, a storage tank that stores flush water therein, a tap water direct connection system, a flush valve system, or a system that supplies flush water using a pump can be applied.

Note that the flush toilet 100 may be a siphon type flush toilet.

Figure 11:
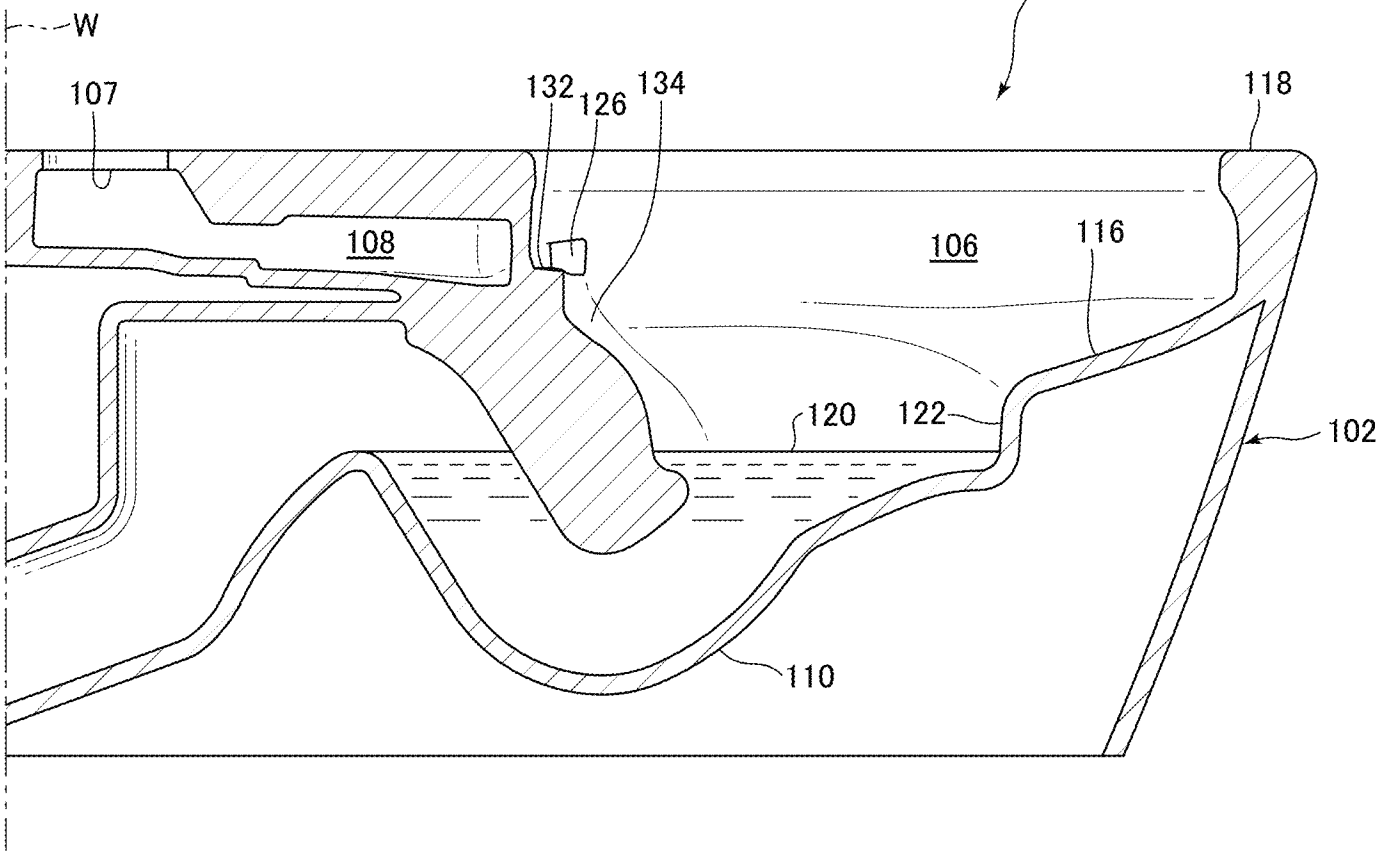
FIG. 11 is a vertical sectional view of the flush toilet according to another embodiment of the present invention, as viewed along line XI-XI in FIG. 10.
Figure 12:
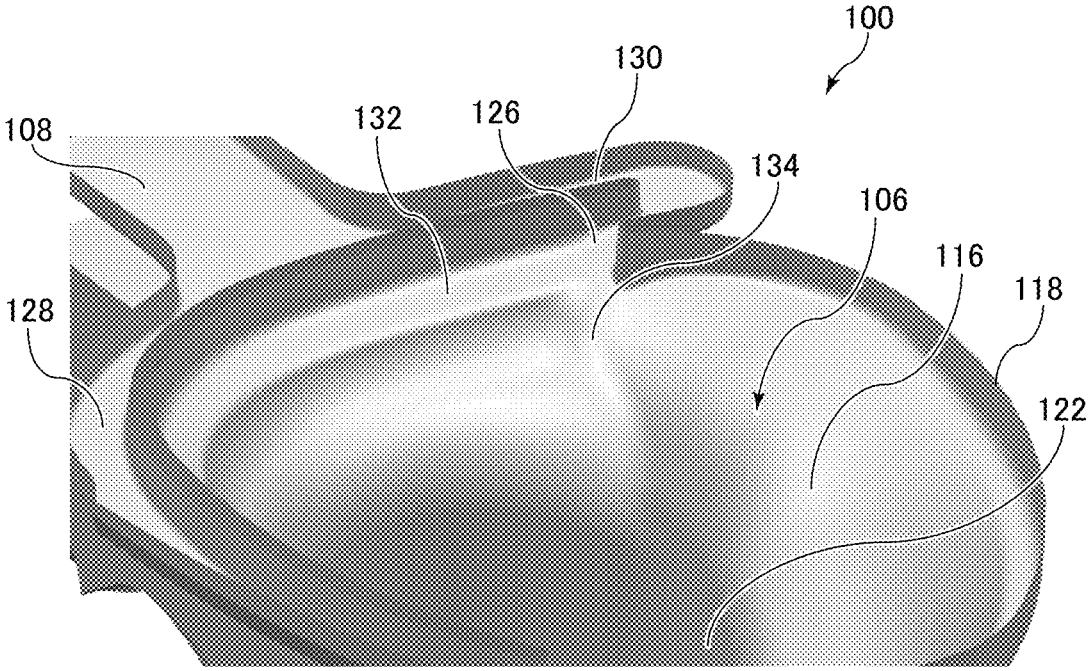
FIG. 12 is a sectional perspective view of a part of the flush toilet according to another embodiment of the present invention, as viewed obliquely from above.

As illustrated in FIGS. 10 to 12, the bowl 106 of the toilet main body 102 includes a bowl-shaped waste receiving surface 116, a rim 118 formed above the waste receiving surface 116, and a well portion 122 formed below the waste receiving surface 116 and having a pooled water surface 120 formed therein.

In the rim 118 in the bowl 106, a first spouting port 124 that spouts flush water is formed on a left-side front side as viewed from the front, and a second spouting port 126 that spouts flush water is formed on a right-side rear side as viewed from the front (in particular, see FIG. 10). Specifically, the first spouting port 124 is provided at a further front side rather than a front end of the pooled water surface 120, and the second spouting port 126 is provided at a further rear side rather than the first spouting port 124 and a rear end of the pooled water surface 120. In the bowl 106, a shelf 132 and a concave portion 134 extending from such a second spouting port 126 are further formed (see FIGS. 10 to 12).

On the other hand, the above-described common water passageway 108 branches into a first water passageway 128 and a second water passageway 130 toward a downstream side, the first water passageway 128 extending to the first spouting port 124 (corresponding to an opening opened at a most downstream end of the first water passageway 128), the second water passageway 130 extending to the second spouting port 126 (corresponding to an opening opened at a most downstream end of the second water passageway 130), so that the flush water from the flush water supply source is supplied to the first spouting port 124 and the second spouting port 126 (see FIGS. 10 and 12). Herein, the first spouting port 124 and the second spouting port 126 spout flush water in a direction of forming a circulating flow which circulates in the same direction. In another embodiment, a counterclockwise circulating flow is formed.

Figure 13:
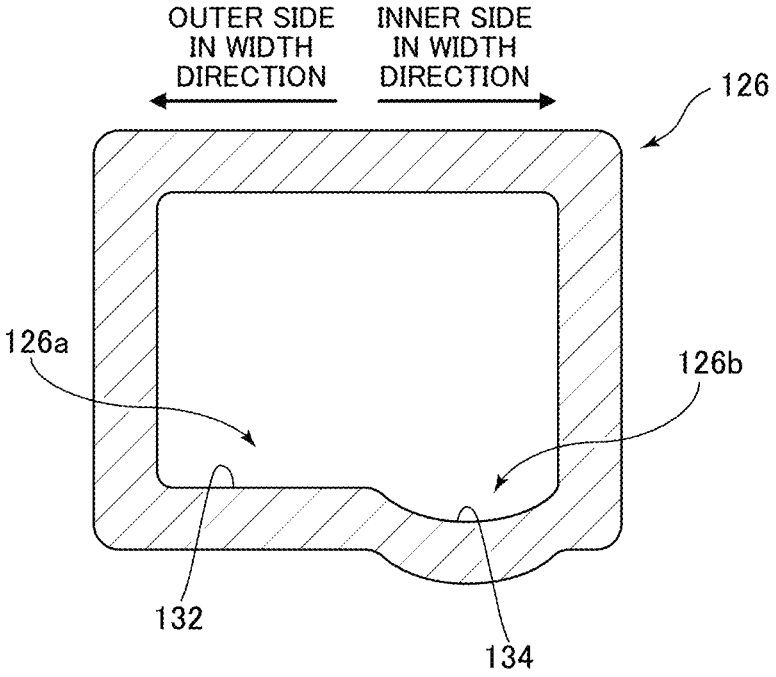
FIG. 13 is a sectional view of a second spouting port according to another embodiment of the present invention, as viewed along line XIII-XIII in FIG. 10.
Figure 14A:
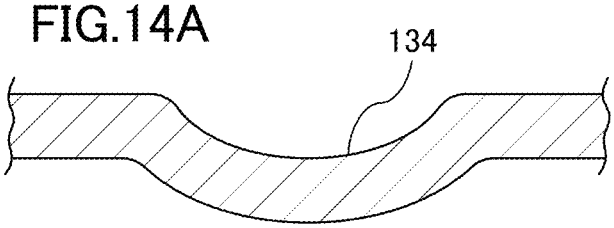
FIG. 14A is a sectional view of a concave portion according to another embodiment of the present invention, as viewed along line XIVA-XIVA in FIG. 10.
Figure 14B:
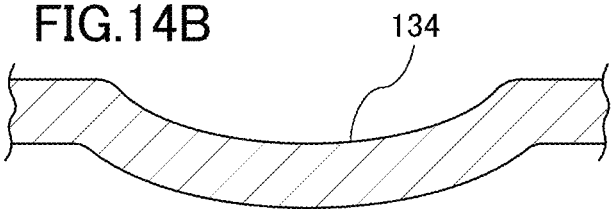
FIG. 14B is a sectional view of the concave portion according to another embodiment of the present invention, as viewed along line XIVB-XIVB in FIG. 10.

Next, the shelf 132 and the concave portion 134 formed in the bowl 106 as described above will be described in detail with reference to FIGS. 10 to 14A, and 14B. FIG. 13 is a sectional view of the second spouting port 126 according to another embodiment of the present invention, as viewed along line XIII-XIII in FIG. 10. FIG. 13 illustrates a substantially rectangular surface (water spout surface) formed by the second spouting port 126 as the most downstream end of the second water passageway 130. FIG. 14A is a sectional view of the concave portion 134 according to another embodiment, as viewed along line XIVA-XIVA in FIG. 10, and FIG. 14B is a sectional view of the concave portion 134 according to another embodiment, as viewed along line XIVB-XIVB in FIG. 10.

As illustrated in FIGS. 10 to 12, the shelf 132 in the bowl 106 is formed above the waste receiving surface 116, that is, is formed in an upper portion of the waste receiving surface 116 and in a lower portion of the rim 118, and extends along the rim 118 from the second spouting port 126. In this case, the shelf 132 extends toward the first spouting port 124 along the rim 118 from the second spouting port 126. Note that in an example illustrated in FIG. 10 (also see FIG. 15), the shelf 132 extends only to a position corresponding to the vicinity of the center of the first water passageway 128, but may extend to the vicinity of the first spouting port 124.

As illustrated in FIG. 4, the second water conduit 32 is formed to extend from the first portion 26*a* which is located on one side in the width direction in the second rim spouting port 26, but is not formed in the second portion 26*b* other than the first portion 26*a*, the second portion 26*b* being located on the other side in the width direction in the second rim spouting port 26. Specifically, the first portion 26*a* is located on an outer side in the width direction in the second rim spouting port 26 (in other words, on the rear side in the second rim spouting port 26), whereas the second portion 26*b* is located on an inner side in the width direction in the second rim spouting port 26 (in other words, on a front side in the second rim spouting port 26). Regarding the outer side in the width direction and the inner side in the width direction in the second rim spouting port 26, a side toward the pooled water surface 20 is defined as an "inner" side and a side apart from the pooled water surface 20 is defined as an "outer" side. For example, the first and second portions 26*a* and 26*b* are formed with a center position in the width direction of the second rim spouting port 26 as a boundary. That is, the first portion 26*a* is an outer portion of the center in the width direction of the second rim spouting port 26, and the second portion 26*b* is an inner portion of the center in the width direction of the second rim spouting port 26.

On the other hand, as illustrated in FIGS. 10 to 12, the concave portion 134 in the bowl 106 extends toward the pooled water surface 120 from the second rim spouting port 126, specifically, from the second portion 126*b* of the second rim spouting port 126 (see FIG. 13). The concave portion 134 is formed in a fan shape expanding from the second portion 126*b* of the second rim spouting port 126 toward the pooled water surface 120 (in particular, see FIG. 10). In other words, the width in the lateral direction of the concave portion 134 increases toward the pooled water surface 120 (that is, the downstream side). This is clear from the fact that the width (see FIG. 14B) of a certain portion on the downstream side of the concave portion 134 is larger than the width (see FIG. 14A) of a portion of the concave portion 134 on the upstream side of the certain portion, as illustrated in FIGS. 14A and 14B, for example.

Figure 15:
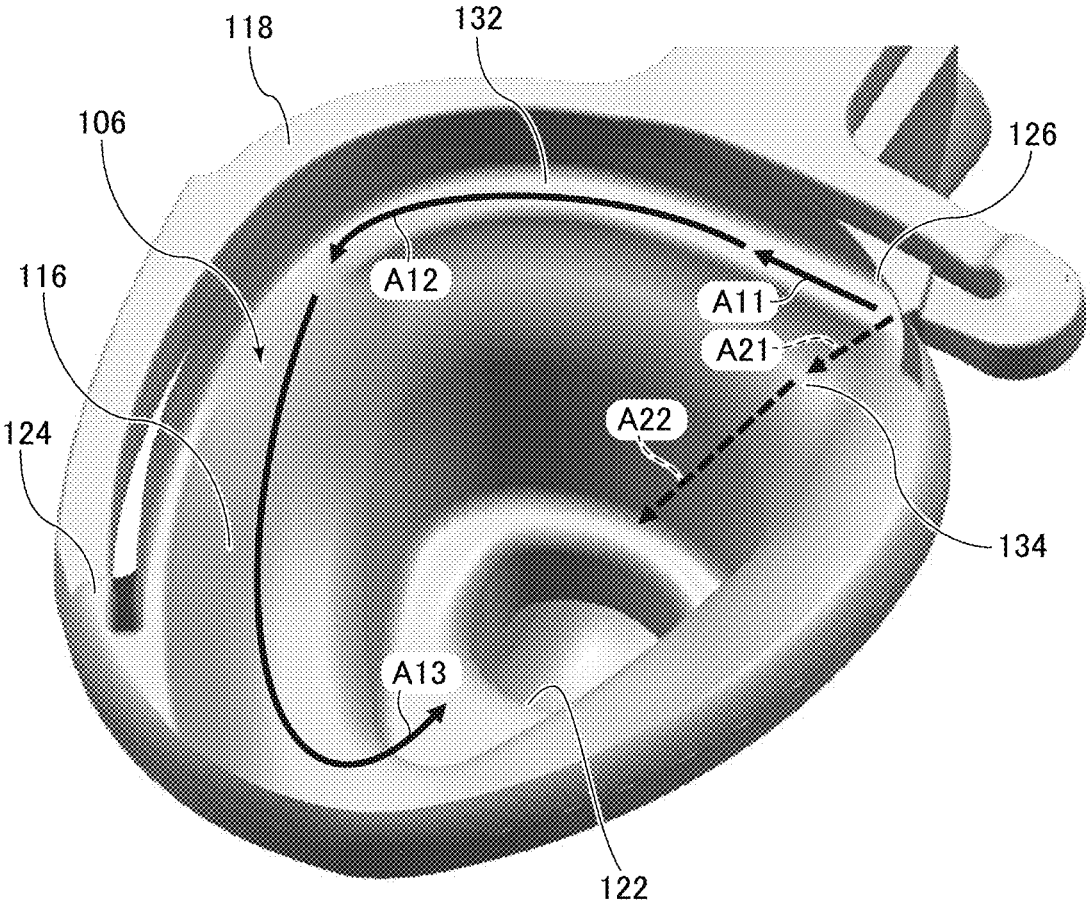
FIG. 15 is an explanation diagram of an action and an effect of the flush toilet according to another embodiment of the present invention.

Next, an action and an effect of the flush toilet 100 according to another embodiment described above will be described with reference to FIG. 15. FIG. 15 is a perspective view of the bowl 106 of the flush toilet 100 according to another embodiment, as viewed obliquely from above. In particular, this figure is an explanation diagram of the flow of flush water spouted from the second rim spouting port 126 of the bowl 106.

As described above, in the flush toilet 100 according to another embodiment, the bowl 106 includes the shelf 132 that is formed between the waste receiving surface 116 and the rim 118 and extends along the rim 118 from the second rim spouting port 126, and the shelf 132 is formed to extend from the first portion 126*a* which is located on the outer side in the width direction in the second rim spouting port 126, but is not formed in the second portion 126*b* other than the first portion 126*a*, the second portion 126*b* being located on an inner side in the width direction in the second spouting port 126. Accordingly, the flush water spouted from the second rim spouting port 126 is distributed into the flush water flowing out through the first portion 126*a* of the second rim spouting port 126 (arrow A11) and the flush water flowing out through the second portion 126*b* of the second rim spouting port 126 (arrow A21).

The flush water flowing out through the second portion 126*b* of the second rim spouting port 126 (arrow A21) flows directly into the pooled water surface 120 (arrow A22). This enables a part of the flush water spouted from the second rim spouting port 126 to flow into the pooled water surface 120 in an early stage. As a result, it is possible to suppress the disturbance of the surface of the pooled water surface 120 by making constant the pressing pressure applied on each region of the pooled water surface 120 by the flush water, and secure drainage of the floating wastes. On the other hand, the flush water having flowed out through the first portion 126*a* of the second rim spouting port 126 (arrow A11) flows on the shelf 132 along the rim 118 (arrow A12), and then circulates on the waste receiving surface 116 and flows into the pooled water surface 120 (arrow A13). This can secure flushing on the waste receiving surface 116 by a part of the flush water spouted from the second rim spouting port 126 (remaining flush water other than the flush water flowing out through the second portion 126*b*). As described above, according to another embodiment, both of drainage of floating wastes and flushing on the waste receiving surface 116 can be secured.

According to another embodiment, in the waste receiving surface 116 in the bowl 106, the concave portion 134 extending from the second portion 126*b* of the second rim spouting port 126 toward the pooled water surface 120 is formed. This enables the flush water flowing out through the second portion 126*b* to be guided to the pooled water surface 120 by the concave portion 134, which makes it possible to cause the flush water to effectively flow into the pooled water surface 120 in an early stage.

According to another embodiment, the concave portion 134 is formed in a fan shape expanding from the second portion 126*b* of the second rim spouting port 126 toward the pooled water surface 120. This enables the flush water flowing out through the second portion 126*b* to flow into a wide range of the pooled water surface 120.

According to another embodiment, the shelf 132 extends toward the first spouting port 124 along the rim 118 from the first portion 126*a* of the second rim spouting port 126. In this way, the shelf 132 can cause the flush water flowing out through the first portion 126*a* of the second rim spouting port 126 to effectively circulate, to secure flushing on the waste receiving surface 116. The shelf 132 preferably extends to the vicinity of the first spouting port 124. This enables more secure flushing on the waste receiving surface 116.

According to another embodiment, the first portion 126*a* of the second rim spouting port 126 is an outer portion of the center in the width direction of the second rim spouting port 126, and the second portion 126*b* of the second rim spouting port 126 is an inner portion of the center in the width direction of the second rim spouting port 126. This enables the flush water spouted from the second rim spouting port 126 to be evenly distributed into the flush water flowing out through the first portion 126*a* and the flush water flowing out through the second portion 126*b*, which makes it possible to effectively secure both of drainage of floating wastes and flushing on the waste receiving surface 116.

Note that the above-described embodiment is for the purpose of describing the present invention, and the present invention is not limited to this embodiment. The present invention can be implemented in various modes without departing from the spirit and scope of the invention.

What is claimed is:

1. A flush toilet for discharging wastes with flush water supplied from a flush water supply source, the flush toilet comprising:

a bowl including a waste receiving surface configured to receive wastes, a rim formed above the waste receiving surface and having an inner circumference surface, and a well portion formed below the waste receiving surface and having a pooled water surface formed in the well portion;

a first spout part having a first rim spouting port provided in the rim and formed to spout flush water forward along the inner circumference surface of the rim;

a first water conduit configured to supply flush water supplied from the flush water supply source to the first spout part;

a second spout part having a second rim spouting port provided in the rim and formed to spout flush water rearward along the inner circumference surface of the rim;

a second water conduit configured to supply flush water supplied from the flush water supply source to the second spout part; and a water discharge conduit connected to a bottom portion of the bowl, wherein a bottom surface of the second water conduit is configured to be inclined downward along a water spouting direction of the flush water spouted from the second rim spouting port, and such that an extension line of the bottom surface crosses vertical surfaces of the well portion above a maximum ascending water level of the pooled water surface during flushing.

2. The flush toilet according to claim 1, wherein an upper surface of the second water conduit is inclined downward from upstream toward downstream.

3. The flush toilet according to claim 2, wherein the upper surface of the second water conduit includes an upstream-side upper surface that is inclined downward at a first inclination angle, and a downstream-side upper surface that is inclined downward at a second inclination angle gentler than the first inclination angle.

4. The flush toilet according to claim 1, wherein the second rim spouting port is formed to be directed toward the pooled water surface.

5. The flush toilet according to claim 1, wherein the second water conduit has a flow channel cross section in which a lower corner on an outer side and a lower corner on an inner side are formed with the same curvature radius.

6. The flush toilet according to claim 1, wherein the second rim spouting port is configured in which, in a front view, a lower corner on an outer side of the second rim spouting port is formed with a first curvature radius, and a lower corner on an inner side of the second rim spouting port is formed with a second curvature radius, and the first curvature radius is further formed to be larger than the second curvature radius.

7. The flush toilet according to claim 6, wherein the bowl on a downstream side of the second rim spouting port is formed continuously with the lower corner on the outer side of the second rim spouting port, and is formed with each curvature radius gradually increasing from the first curvature radius toward a water spouting direction of the flush water.

8. The flush toilet according to claim 1, wherein the bowl further includes a shelf formed between the waste receiving surface and the rim, and extending along the rim from a second spouting port, and the shelf is formed to extend from a first portion which is located on an outer side in a width direction in the second spouting port, but is not formed in a second portion other than the first portion, the second portion being located on an inner side in the width direction in the second spouting port.

9. The flush toilet according to claim 1, wherein an enlarged part, in which a space enlarging along the water spouting direction from the second rim spouting port is formed, is provided above a downstream side of the second rim spouting port of the rim.

* * * * *